US006862000B2

(12) United States Patent
Desargant et al.

(10) Patent No.: US 6,862,000 B2
(45) Date of Patent: Mar. 1, 2005

(54) REFLECTOR ANTENNA HAVING LOW-DIELECTRIC SUPPORT TUBE FOR SUB-REFLECTORS AND FEEDS

(75) Inventors: Glen J. Desargant, Fullerton, CA (US); Albert L. Bien, Anaheim, CA (US); Orville L. Reid, Anaheim, CA (US)

(73) Assignee: The Boeing Company, Chicago, IL (US)

( * ) Notice: Subject to any disclaimer, the term of this patent is extended or adjusted under 35 U.S.C. 154(b) by 70 days.

(21) Appl. No.: 10/059,765

(22) Filed: Jan. 28, 2002

(65) Prior Publication Data

US 2003/0142029 A1 Jul. 31, 2003

(51) Int. Cl.[7] ..... H01Q 19/19; H01Q 19/12

(52) U.S. Cl. ..... 343/840; 343/781 CA

(58) Field of Search ..... 343/840, 775, 343/781 R, 781 P, 781 CA, 782; H01Q 19/19, 19/12

(56) References Cited

U.S. PATENT DOCUMENTS

| | | | | |
|---|---|---|---|---|
| 3,530,480 A | * | 9/1970 | Rongved et al. | 343/781 CA |
| 3,771,161 A | * | 11/1973 | Phillips | 343/840 |
| 4,178,576 A | * | 12/1979 | Schmidt, Jr. et al. | 343/781 R |
| 4,673,945 A | * | 6/1987 | Syrigos | 343/755 |
| 6,307,509 B1 | * | 10/2001 | Krantz | 343/700 MS |
| 6,509,880 B2 | * | 1/2003 | Sabet et al. | 343/700 MS |

FOREIGN PATENT DOCUMENTS

| | | |
|---|---|---|
| DE | 27 15 796 | 10/1978 |
| EP | 1 128 468 A2 | 8/2001 |
| GB | 1 568 132 | 5/1980 |
| JP | 63-269809 | 11/1988 |
| JP | 9-199937 | 7/1997 |
| WO | WO 96/39729 | 12/1996 |

OTHER PUBLICATIONS

International Search Report issued Jun. 16, 2003 for corresponding International Application No. PCT/US 03/01712.

* cited by examiner

*Primary Examiner*—Hoanganh Le
(74) *Attorney, Agent, or Firm*—Harness Dickey & Pierce P.L.C.

(57) ABSTRACT

An antenna exhibiting improved transmission and reception capabilities. The antenna does not make use of a solid support tube or solid support rods used by previous antennas to support a sub-reflector or other device above a main reflector of the antenna. Instead, the antenna employs the use of a low dielectric constant, perforated, support tube to support the sub-reflector, patch antenna, or other form of antenna element above the main reflector. The perforated support tube permits radio frequency signals to pass through the tube, thus decreasing signal degradation experienced due to reflection of the signal off the solid support tube or off the solid support rods.

45 Claims, 3 Drawing Sheets

REFLECTOR ANTENNA HAVING LOW-DIELECTRIC SUPPORT TUBE FOR SUB-REFLECTORS AND FEEDS

FIELD OF THE INVENTION

The present invention relates to antennas. More specifically, the invention relates to a method and apparatus for providing an antenna exhibiting improved signal reception and transmission due to reduced levels of signal reflection ices and dielectric loss.

BACKGROUND OF THE INVENTION

Electromagnetic wave antennas, and radio frequency (RF) antennas in particular, are widely used to transmit and receive energy in the form of radio waves. RF antennas are available in many different shapes, sizes and configurations. One type of RF antenna is the Cassegrain antenna. Cassegrain antennas have a hyperbolic shaped sub-reflector. The sub-reflector is coaxially aligned with and aimed at an axial center of a main parabolic reflector. The sub-reflector Is suspended above the main reflector by either a solid support tube extending from a point near the center of the main reflector, one or more support rods extending from a point near the center of the reflector, or one or more support rods extending from a periphery of the main reflector. When the antenna is in the receive mode the sub-reflector directs RF energy received and reflected by the main reflector to a waveguide (i.e., feedhorn) located at the axial center of the main reflector. When the antenna is in the transmit mode, RF energy transmitted from the waveguide is reflected by the sub-reflector onto the main reflector where the energy is radisted from the antenna.

While the above described Cassegrain antenna is able to adequately send and receive radio signals, it would be desirable to improve its operating efficiency. Specifically, Cassegrain antennas and all other types of antennas which employ the use of a device suspended above a main reflector, such as a horn antenna, patch antenna, etc., suffer transmission losses due to the RF signal being blocked and reflected by the device support members. Such support members are usually in the form of solid support tubes or support rods that exhibit large dielectric constants. Consequently, there is a need for an improved antenna exhibiting reduced levels of reflection loss and dielectric loss, resulting in enhanced RF signal transmission and reception.

SUMMARY OF THE INVENTION

The present Invention overcomes prior art deficiencies by providing an antenna exhibiting improved transmission and reception capabilities. Unlike previous antennas, the antenna of the present invention does not make use of a solid support tube or solid support rods to support a sub-reflector or other feed device above a main reflector of the antenna. Instead, the present invention provides an antenna having a sub-reflector or other feed device positioned above a main reflector by a perforated support device (dielectric), or support tube, having walls with a low dielectric constant. The perforated support tube permits RF signals to pass through the tube, thus decreasing the signal degradation which would be experienced due to reflection of the signal off the walls of a solid support tube or solid support rods. The perforations may be in the form of holes, slots, or numerous other arrangements.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
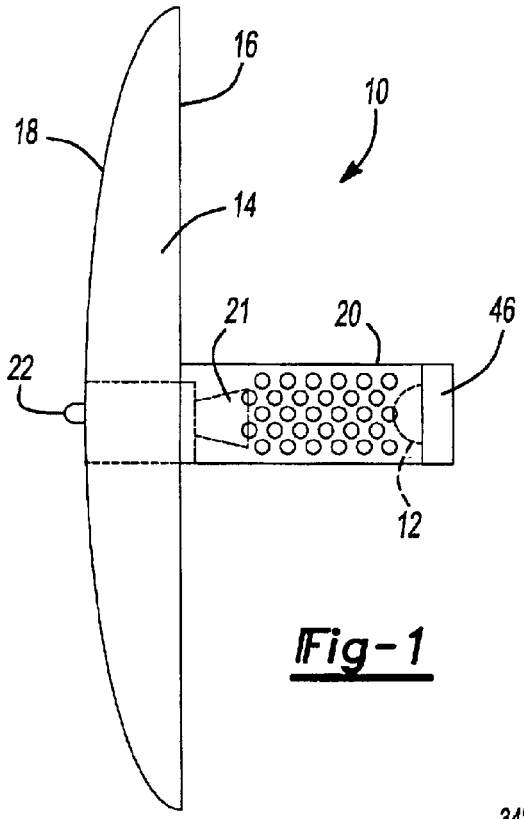
FIG. 1 is a side view of an antenna in accordance with a first preferred embodiment of the present invention.

As seen in FIG. 1, an antenna 10 in accordance with a first preferred embodiment of the present invention is shown. The antenna 10 contains a hyperbolic sub-reflector 12 and a parabolic main reflector 14. The main reflector 14 has a first surface 16 and a second surface 18. The sub-reflector 12 is mounted to the first surface 16 by a perforated plastic support tube 20. Electromagnetic wave signals, such as RF signals, received by the first surface 16 are reflected by the sub-reflector 12 to a waveguide in the form of a feedhorn 21. Electromagnetic wave signals, such as RF signals, transmitted through the feedhorn 21 are reflected by the sub-reflector 12 to the first surface 16 and radiate from the first surface 16 into space. RF signals received by the antenna 10 are carried from the antenna 10 through a suitable conducting device, such as a coaxial cable (not shown). The conducting device may also carry RF signals to antenna 10 to be transmitted by antenna 10. The conducting device is connected to the antenna 10 by way of a TNC connector 22 disposed on the second surface 18 of antenna 10.

Figure 2A:
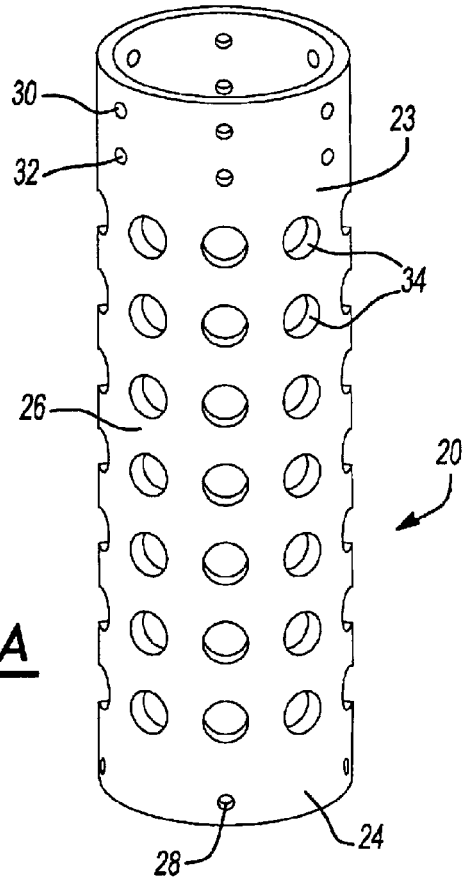
FIG. 2*a* is a perspective view of the perforated support tube of the antenna of FIG. 1.
Figure 2B:
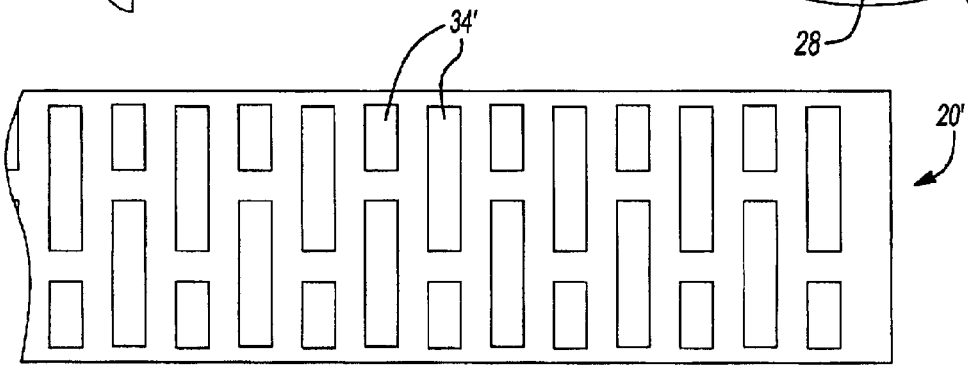
FIG. 2*b* is a side view of an alternative preferred form of the support tube.
Figure 2C:
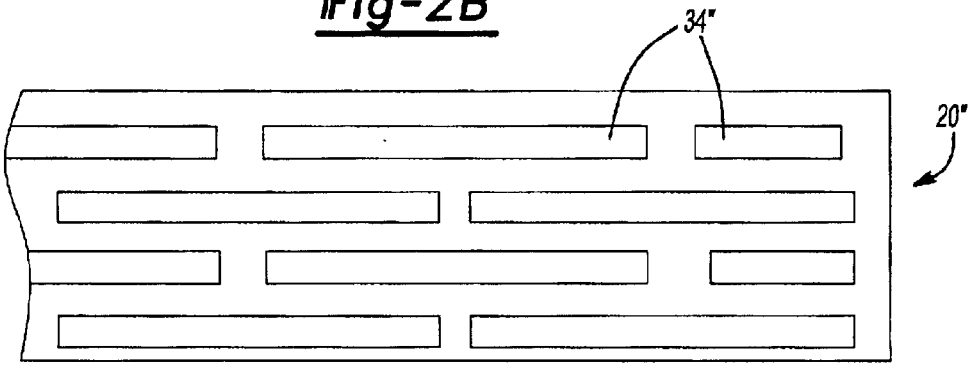
FIG. 2*c* is a side view of another alternative preferred form of the support tube.

With reference to FIG. 2, the perforated plastic support tube 20 will now be described in detail. The perforated tube 20 is comprised of a top portion 23, a bottom portion 24, and a mid-portion 26. The bottom portion 24 contains a series of small holes 28 capable of receiving suitable fastening devices, such as threaded fastening devices or rivets. The top portion 23 similarly contains a first series of small holes 30 and a second series of small holes 32, both capable of receiving suitable fastening devices, such as the fasteners or rivets described above. Mid-portion 26 contains a plurality of apertures 34, the apertures 34 being of any suitable size or configuration so as to allow the passage of RF signals easily through the tube 20. The apertures 34 may be in the form of circular holes as illustrated in FIG. 2*a*. An alternative form of the support tube 20' is shown in FIG. 2B wherein the circular holes are replaced by radial slot openings 34'. Still another preferred form of the support tube 20" is shown in FIG. 2C wherein the circular holes are replaced by longitudinal slot openings 34". In one preferred form the support tube 20 is formed from a suitably strong plastic, although it will be appreciated that other materials such as, but not limited to, steel or aluminum may also be used. A perforated steel or aluminum support tube could function as a frequency selective surface (FSS).

Figure 3:
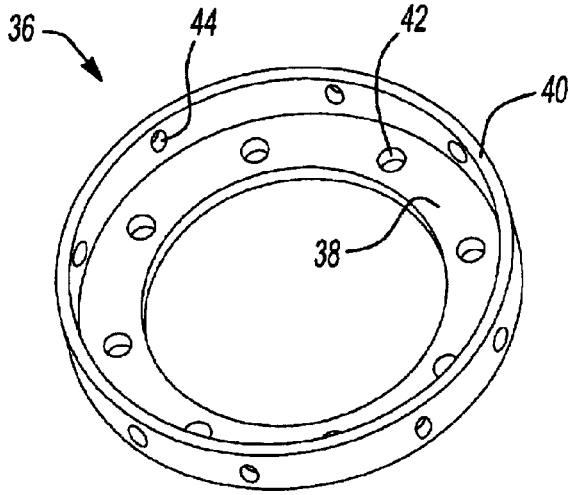
FIG. 3 is a perspective view of the attachment ring of the antenna of FIG. 1.

The perforated tube 20 is affixed to the first surface 16 of the main reflector 14 by way of an attachment ring 36 shown in FIG. 3. The attachment ring 36 is a circular ring comprised of a base portion 38 and an annular rim 40. Formed within the base portion 38 is a plurality of small holes 42 capable of receiving suitable fastening devices such as threaded screws. Similar small holes 44 capable of receiving fastening devices, such as threaded screws, are formed in the annular rim 40.

The small holes 42 of the base portion 38 cooperate with similar holes (not shown) circumscribing the focal point of the first surface 16 of the main reflector 14. Suitable fastening devices are inserted through small holes 42 and the holes (not shown) of the first surface 16 to secure the base portion 38 to the first surface 16. The base portion 38 serves as a support to secure the perforated support tube 20 to the main reflector 14. Specifically, the perforated support tube 20 is secured to the attachment ring 36 through cooperation of small holes 44 of the annular rim 40 and small holes 28 of the support tube 20. Small holes 28 and small holes 44 are secured to each other by a suitable fastening device such as screws that are inserted through aligned pairs of small holes 28 and 44.

Figure 4:
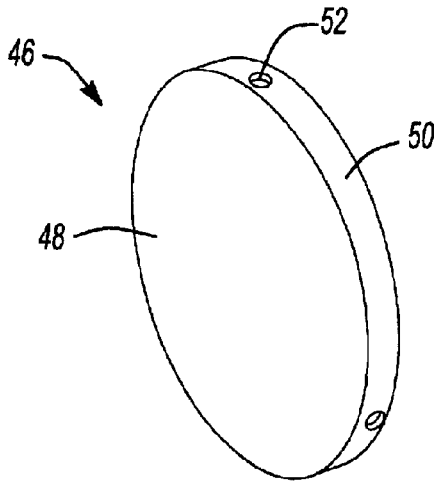
FIG. 4 is a perspective view of the support tube cap of the antenna of FIG. 1.

The top portion 23 of the perforated support tube 20 is covered by a support tube end cap 46 as shown in FIG. 4. The cap 46 is comprised of a flat surface portion 48 and a rim portion 50. The rim portion 50 contains a plurality of small holes 52 for receiving suitable fastening devices such as threaded fasteners or rivets. The small holes 52 are aligned with the first series of small holes 30 and end cap 46 is secured to the support tube 20 by fastening devices extending through the aligned pairs of small holes 30 and 52.

Figure 5:
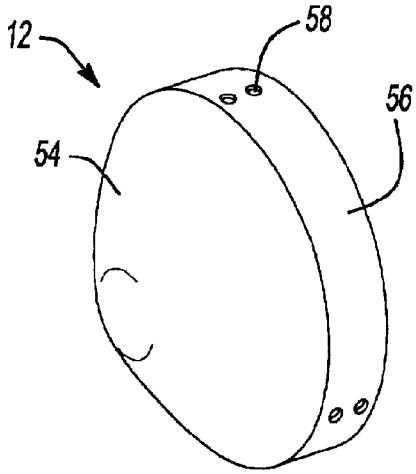
FIG. 5 is a perspective view of the sub-reflector of the antenna of FIG. 1.

Referring now to FIG. 5, the sub-reflector 12 is shown in detail. The sub-reflector 12 contains a cone portion 54 and a circular peripheral base portion 56. The peripheral base portion 56 contains a series of small holes 58 that cooperate with the second series of small holes 32. Suitable fastening elements are inserted through aligned pairs of small holes 58 and small holes 32 to secure the sub-reflector 12 to the perforated support tube 20.

Figure 6:
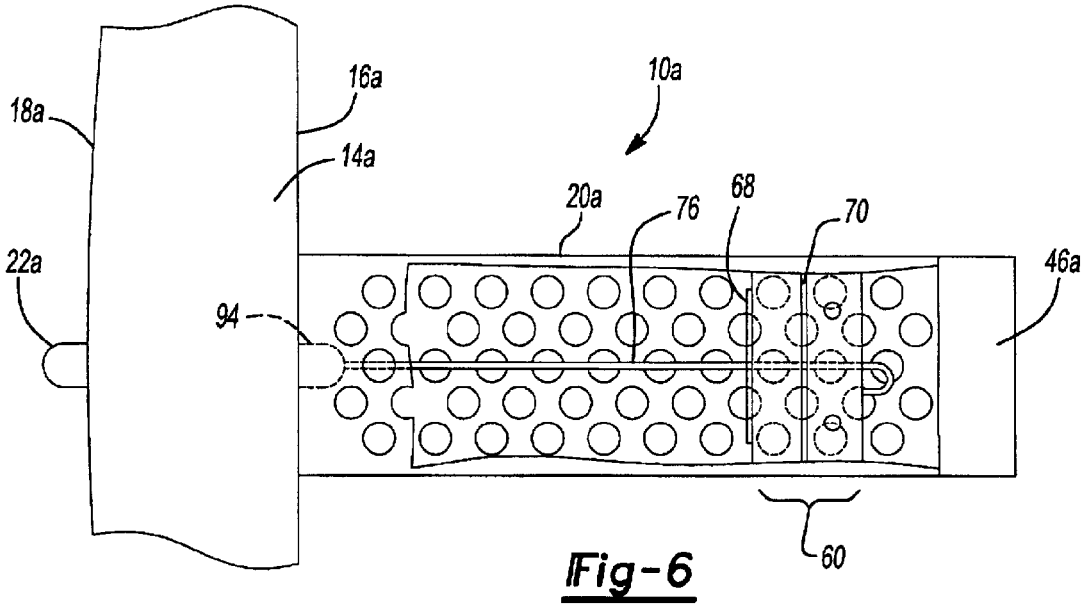
FIG. 6 is a partial side view of an antenna in accordance with a second preferred embodiment of the present invention with a broken away section of the support tube to better show the patch antenna assembly.

As seen in FIG. 6, an antenna 10*a* in accordance with a second preferred embodiment of the present invention is shown. Antenna 10*a*, like antenna 10 of the first preferred embodiment, is comprised of a parabolic main reflector 14*a* having a first surface 16*a* and a second surface 18*a*. Mounted to the first surface 16*a*, by way of an attachment ring 36*a*, is a perforated plastic support tube 20*a* having an end cap 46*a*. Mounted to the second surface 18*a* is a TNC connector 22*a*. As these components of antenna 10*a* are identical to those of antenna 10, there is no need to describe them again in detail with reference to antenna 10*a*.

Figure 7:
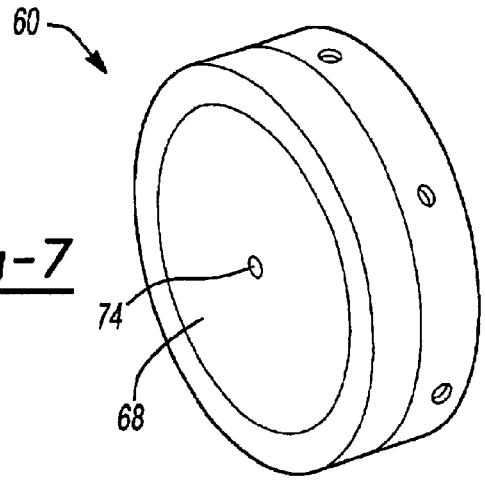
FIG. 7 is a perspective view of the patch assembly of the antenna of FIG. 6.
Figure 9:
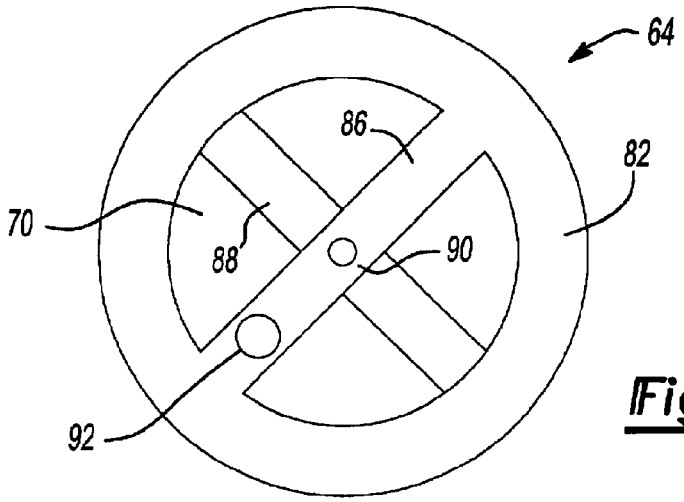
FIG. 9 is a top view of the patch assembly of the antenna of FIG. 6.
Figure 8:
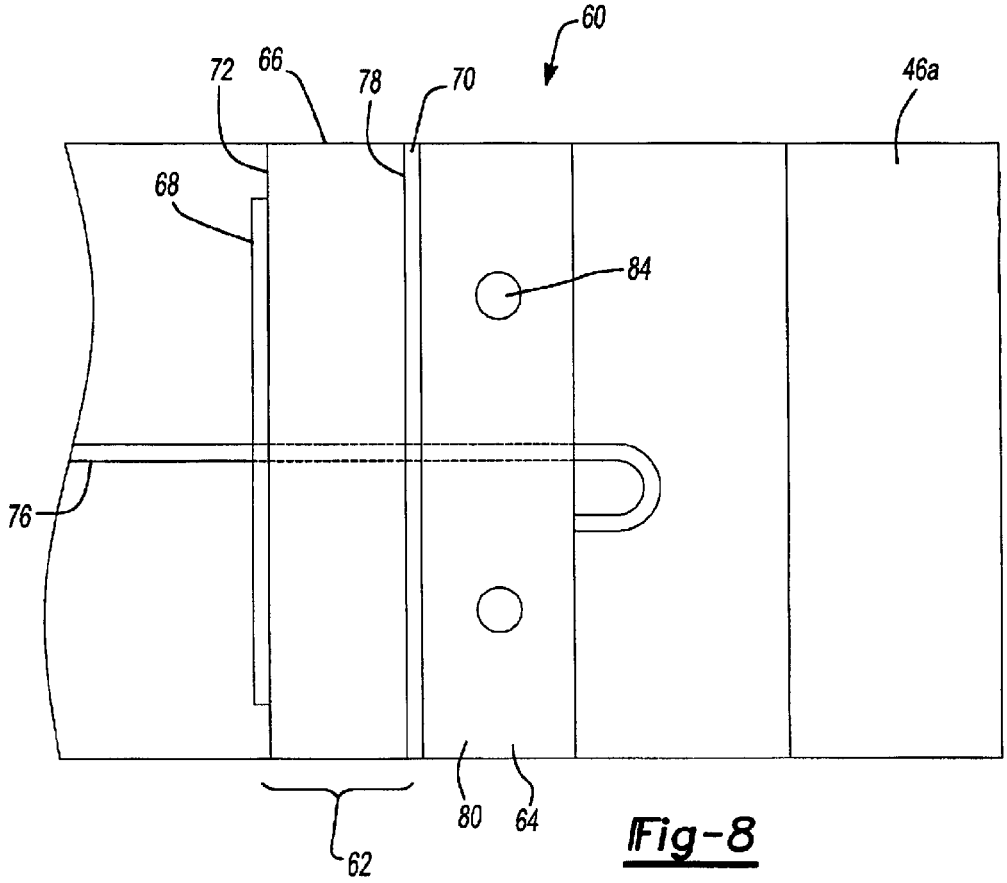
FIG. 8 is a side view of the patch assembly of the antenna of FIG. 6.

In addition to the antenna elements described above, antenna 10*a* has a patch antenna assembly 60. The patch antenna assembly 60 is illustrated in detail in FIGS. 7, 8, and 9. The patch antenna assembly 60 is generally comprised of a patch antenna 62 and a patch attachment ring 64. The patch antenna assembly 60 is mounted to the first surface 16*a* by the perforated plastic support tube 20*a*.

The patch antenna 62 is comprised of a dielectric substrate 66, a patch element 68 and a ground plane 70. Both the patch element 68 and the ground plane 70 are preferably made of copper. The copper patch element 68 covers a first end 72 of the dielectric substrate 66, except for an outer periphery of the first end 72. At the center of the patch element 68 is hole 74 which is used to receive a suitable conducting device such as coaxial cable 76. A corresponding hole (not shown) is located in dielectric substrate 66.

The ground plane 70 completely covers and is bonded to a second end 78 of the dielectric substrate 66. The ground plane 70 is preferably made of copper and includes a hole (not shown) aligned with hole 74 of the patch element 68 and the hole (not shown) of the dielectric substrate 66. The surface of the ground plane not bonded to the dielectric substrate 66 is bonded to the patch attachment ring 64.

The patch attachment ring 64 is preferably made of metal. The patch attachment ring 64 is comprised of a ring portion 80 and a surface portion 82. The ring portion 80 contains a plurality of small holes 84. The plurality of small holes 84 are aligned with the second series of small holes 32*a* of the support tube 20*a* and both are capable of receiving suitable fastening devices, such as fasteners or rivets, to secure the patch antenna assembly 60 to the support tube 20*a*.

The surface portion 82 of the patch attachment ring 64 contains cross members 86 and 88. At the intersect point of cross members 86 and 88 is a hole 90. Hole 90 is sized to receive coax cable 76 and is aligned with hole 74, the hole of the dielectric substrate 66, and the hole of ground plane 70. Either cross member 86 or cross member 88 also has a connector 92 for receiving the coax cable 76.

RF signals received by the main reflector 14*a* of antenna 10*a* are directed from the main reflector 14*a* to the patch antenna 62. From the patch antenna 62 the RF signals are conducted through the coaxial cable 76 to a TNC connector 94 disposed at the axial center of the first surface 16*a* of the main reflector 10*a*. From connector 94 the signals are conducted from the antenna by way of a suitable conductive device, such as a coaxial cable (not shown), that is attached to connector 22*a*. Likewise, RF signals to be transmitted by antenna 10*a* are received by the antenna 10*a* through connector 22*a* and are carried to the patch antenna 62 by way of the coaxial cable 76. The RF signals to be transmitted radiate from the patch antenna 62 where they are reflected by the first surface 16*a* of the main reflector 14*a* into space. It must be noted that antenna 10*a* does not require the use of a feedhorn as antenna 10 does.

While FIGS. 1, 2, and 6 illustrate the second series of small holes 32 being used to support the sub-reflector 12 and the patch assembly 60, it should be understood that small holes 32 may be configured to support a variety of antenna-related elements called for in a variety of different antennas. It will also be appreciated that other forms of fastening systems, including adhesives, could be used in place of the threaded fastening elements and rivets described herein.

The use of perforated tube 20 to support the sub-reflector 12, patch assembly 60, or any other device enhances the signal strength of the signal received or transmitted by the antenna 10. Traditionally, the sub-reflector 12, patch assembly 60, or other device has been suspended above the main reflector 14 by a solid support tube or solid support rods. However, such a configuration is undesirable because the RF energy radiated or transmitted from the antenna reflects off the solid support tube or solid support rods due to the high dielectric constant exhibited by such supports. As a result of this high dielectric constant, the signal strength of the RF signal received by, or transmitted from, the antenna is degraded.

In contrast to the prior art antennas, perforated support tube 20 exhibits a decreased dielectric constant as the apertures 34 allow RF signals to pass though the support tube 20 with the signals being reflected less frequently. Because the RF signals are reflected less frequently, antenna 10 is more efficient and is able to receive and transmit RF energy with less signal degradation.

Thus, an improved antenna exhibiting a perforated support tube with a decreased wall dielectric constant and, consequently, decreased levels of signal degradation due to signal reflection is provided. The decrease in signal degradation is due to the presence of the perforated support tube 20 to support the sub-reflector 12, patch assembly 60, or any other desired device above the main reflector 14. The use of perforated support tube 20 provides an antenna 10 which exhibits a dielectric constant that is significantly lower than prior art antennas. Consequently, RF signal reflection loss is reduced by the perforated support tube and the RF signals received or transmitted are of a greater strength and quality than the signals of prior art antennas. The principles of the present invention are applicable to all support tubes (dielectric) with perforated holes or slots in the wall of the tube to lower the effective dielectric constant.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An antenna having improved radio frequency (RF) transmission and reception capabilities, comprising:

a main reflector;

an antenna element;

a support tube disposed at said axial center of said main reflector for supporting said antenna element in facing relationship to said main reflector, said support tube having a plurality of apertures therein; and said apertures in said support tube serving to effectively reduce a dielectric constant of said support tube to thereby improve a signal strength of RF signals received by or transmitted from said antenna.

2. The antenna of claim 1, wherein said antenna element comprises a parabolic shaped sub-reflector, said sub-reflector aligned with said axial center of said main reflector.

3. The antenna of claim 2, wherein said antenna includes a waveguide at an axial center of said main reflector.

4. The antenna of claim 1, wherein said antenna element comprises a patch antenna, said patch antenna being able to relay RE signals to an input connector through a coaxial feed cable.

5. The antenna of claim 1, wherein said apertures in said support tube are arranged in a plurality of columns circumferentially about said support tube.

6. The antenna of claim 1, further comprising a support tube end cap for covering one end of said support tube.

7. The antenna of claim 1, wherein said main reflector comprises a hyperbolic shaped main reflector.

8. The antenna of claim 1, wherein said support tube includes a plurality of circular apertures.

9. The antenna of claim 1, wherein said support tube comprises a plurality of radial slots.

10. The antenna of claim 1, wherein said support tube comprises a plurality of longitudinal slots.

11. The antenna of claim 1, wherein said support tube comprises a plurality of differing slot shapes formed therein.

12. The antenna of claim 1, wherein said support tube comprises a plurality of differing hole shapes formed therein.

13. The antenna of claim 1, wherein said support tube comprises a metallic material.

14. The antenna of claim 13, wherein said metallic support tube functions as at least one of a spatial filter and a frequency selective surface.

15. A method for producing an antenna having improved transmission and reception characteristics comprising:

providing a main reflector;

disposing an antenna element in front of said main reflector and coaxially aligned with an axial center of said main reflector so as to face said main reflector; and mounting said antenna element on a support tube having a plurality of openings formed therein so that radio frequency signals may pass more freely through the support tube without being reflected therefrom.

16. The method of claim 15, wherein the step of mounting said antenna element on a support tube comprises mounting said antenna element on a support tube having a plurality of circular apertures arranged in columns about the support tube.

17. The method of claim 15, wherein the step of disposing an antenna element comprises disposing a sub-reflector in front of said main reflector.

18. The method of claim 15, wherein the step of disposing an antenna element comprises disposing a patch antenna in front of said main reflector.

19. A method for producing an antenna having improved transmission and reception characteristics comprising:

providing a main reflector;

disposing a waveguide at an axial center of said main reflector;

disposing a sub-reflector in front of said main reflector and coaxially aligned with an axial center of said main reflector so as to face said main reflector; and mounting said sub-reflector on a support tube having a plurality of openings, wherein the apertures are spaced generally uniformly around the support tube, so that radio frequency signals may pass more freely through the support tube without being reflected therefrom.

20. The method of claim 19, wherein the step of providing a main reflector comprises providing a hyperbolic shaped main reflector.

21. The method of claim 19, wherein the step of disposing a sub-reflector in front of said main reflector comprises disposing a parabolic shaped sub-reflector in front of said main reflector.

22. The method of claim 19, wherein the step of mounting said sub-reflector comprises mounting said sub-reflector on a generally circular support tube, wherein said apertures are arranged in columns around said support tube.

23. An antenna having improved transmission and reception capabilities, comprising:

a main reflector;

a second antenna component; and a support element operable to mount said second antenna component to said main reflector such that said second antenna component is in facing relationship to said main reflector, said support element having at least one aperture;

wherein said aperture reduces a dielectric constant of said support element to enhance antenna performance.

24. The antenna of claim 23, wherein said support element comprises a support tube.

25. The antenna of claim 23, wherein said second antenna component comprises a parabolic shaped sub-reflector aligned with an axial center of said main reflector.

26. The antenna of claim 23, wherein said antenna includes a waveguide at an axial center of said main reflector.

27. The antenna of claim 23, wherein:

said second antenna component comprises:

a patch antenna, said patch antenna operable to relay signals to an input connector through a coaxial feed cable.

28. The antenna of claim 23, wherein said aperture comprises a plurality of apertures arranged in a plurality of columns circumferentially extending about said support element.

29. The antenna of claim 23, wherein said main reflector comprises a hyperbolic shaped main reflector.

30. The antenna of claim 23, wherein said aperture comprises at least one circular aperture.

31. The antenna of claim 23, wherein said aperture comprises at least one longitudinal slot.

32. The antenna of claim 23, wherein said aperture comprises at least one elongated slot.

33. The antenna of claim 23, wherein said aperture comprises a plurality of apertures forming a plurality of differing shapes.

34. The antenna of claim 23, wherein said aperture comprises a plurality of apertures comprising a plurality of differing hole shapes.

35. The antenna of claim 23, wherein said support element comprises a metal tube.

36. The antenna of claim 23, wherein said support element functions as at least one of a spatial filter and a frequency selective surface.

37. A method of producing an antenna having improved transmission and reception capabilities comprising:

mounting a first antenna component to a main reflector using a support element having an opening therein such that said first antenna component is supported in facing relationship to said main reflector and spaced apart from said main reflector;

wherein said opening reduces a dielectric constant of said support element to thereby improve the antenna's performance.

38. The method of claim 37, wherein said mounting step further comprises mounting the first antenna component on a support element having a plurality of circular apertures arranged about the support element.

39. The method of claim 37, wherein said mounting step further comprises mounting the first antenna component to the main reflector using a support tube.

40. The method of claim 37, wherein said mounting step further comprises mounting the first antenna component on a support element having a plurality of slits arranged about the support element.

41. An antenna having improved transmission and reception capabilities comprising:

a main reflector;

a sub reflector aligned with an axial center of said main reflector;

a support element operable to secure said sub reflector to said main reflector, said support element having at least one opening formed therein; and a waveguide positioned at said axial center of said main reflector;

wherein said opening reduces a dielectric constant of said support element.

42. The antenna of claim 41, wherein said support element is a support tube.

43. The antenna of claim 41, wherein said opening is a plurality of generally circular openings.

44. The antenna of claim 41, wherein said opening is a plurality of slots.

45. The antenna of claim 41, wherein said opening is a plurality of slots having approximately the same dimensions.

* * * * *